US006817423B2

(12) United States Patent
Dallas

(10) Patent No.: US 6,817,423 B2
(45) Date of Patent: Nov. 16, 2004

(54) WALL STIMULATION TOOL AND METHOD OF USING SAME

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 23 days.

(21) Appl. No.: 10/162,773

(22) Filed: Jun. 4, 2002

(65) Prior Publication Data

US 2003/0221838 A1 Dec. 4, 2003

(51) Int. Cl.[7] ..... E21B 19/00; E21B 23/00

(52) U.S. Cl. ..... 166/382; 166/77.2; 166/85.4; 166/97.1; 166/75.13

(58) Field of Search ..... 166/281, 308, 166/379, 386, 381, 382, 75.1, 77.1, 77.2, 77.4, 85.1–85.5, 86.1, 86.3, 84.1, 96.1, 75.15, 97.1, 75.13

(56) References Cited

U.S. PATENT DOCUMENTS

| | | | | | |
|---|---|---|---|---|---|
| 4,241,786 | A | | 12/1980 | Bullen | 166/77 |
| 4,632,183 | A | | 12/1986 | McLeod | 166/77 |
| 4,867,243 | A | | 9/1989 | Garner et al. | 66/379 |
| 5,012,865 | A | * | 5/1991 | McLeod | 166/90.1 |
| 5,490,565 | A | * | 2/1996 | Baker | 166/379 |
| 5,785,121 | A | | 7/1998 | Dallas | 166/90.1 |
| 5,819,851 | A | | 10/1998 | Dallas | 166/308 |
| 5,927,403 | A | | 7/1999 | Dallas | 166/77.51 |
| 5,988,274 | A | | 11/1999 | Funk | 166/77.4 |
| 6,145,596 | A | | 11/2000 | Dallas | 166/379 |
| 6,179,053 | B1 | | 1/2001 | Dallas | 166/77.51 |
| 6,209,633 | B1 | | 4/2001 | Haynes | 166/72 |
| 6,220,363 | B1 | | 4/2001 | Dallas | 166/382 |
| 6,234,253 | B1 | | 5/2001 | Dallas | 166/377 |
| 6,247,537 | B1 | | 6/2001 | Dallas | 166/379 |
| 6,289,993 | B1 | | 9/2001 | Dallas | 166/386 |
| 6,364,024 | B1 | | 4/2002 | Dallas | 166/379 |
| 6,412,560 | B1 | * | 7/2002 | Bernat | 166/301 |
| 6,470,965 | B1 | * | 10/2002 | Winzer | 166/77.4 |
| 6,575,247 | B2 | * | 6/2003 | Tolman et al. | 166/305.1 |

OTHER PUBLICATIONS

Patent application Ser. 09/537,629 entitled "Blowout Preventer Protector and Method of Using Same, " filed Mar. 29, 2000.

Patent application Ser. 09/791,980 entitled "Method and Apparatus for Inserting a Tubing Hanger Into a Live Well," filed Feb. 23, 2001.

Patent application Ser. 09/998,953 entitled "Spool for Pressure Containment Used in Rigless Well Completion, Re–Completion, Servicing or Workover, " filed Nov. 15, 2001.

Patent application Ser. 10/034,032 entitled "Slip Spool and Method of Using Same, " filed Dec. 19, 2001.

Patent application Ser. 10/050,024 entitled "Well Stimulation Tool and Method of Using Same, " filed Jan. 15, 2002.

Patent application Ser. 10/162,803 entitled "Reciprocating Lubricator, " filed Jun. 3, 2002.

* cited by examiner

*Primary Examiner*—David Bagnell
*Assistant Examiner*—Jennifer H. Gay
(74) *Attorney, Agent, or Firm*—Nelson Mullins Riley & Scarborough, LLP

(57) ABSTRACT

An apparatus for protecting equipment in a wellhead from exposure to fluid pressures, abrasives and corrosive fluids used in a well treatment to stimulate production, includes a mandrel to be inserted through the wellhead into an operative position. The apparatus further includes injectors for reciprocating the mandrel to and from the operative position. The injectors are connected on their top ends to a connector plate that provides a support platform to permit equipment, such as blowout preventers, wireline units, coil tubing injectors or the like, to be mounted to the top of the apparatus.

21 Claims, 8 Drawing Sheets

WALL STIMULATION TOOL AND METHOD OF USING SAME

FIELD OF THE INVENTION

The present invention relates to equipment for servicing oil and gas wells and, in particular to an apparatus and method for protecting equipment in a wellhead from exposure to fluid pressures, abrasives and corrosive fluids used in a well treatment, while permitting tubing to be run in or out of the well.

BACKGROUND OF THE INVENTION

Most oil and gas wells eventually require some form of stimulation to enhance hydrocarbon flow in order to make or keep them economically viable. The servicing of oil and gas wells to stimulate production requires the pumping of fluids under high pressure. The fluids are generally corrosive and abrasive because they are frequently laden with corrosive acids and abrasive proppants such as sharp sand.

The components which make up the wellhead such as the valves, tubing hanger, casing hanger, casing head and the blowout preventer equipment are generally selected according to the characteristics of the particular well and are not capable of withstanding the fluid pressures required for well fracturing and stimulation procedures. Wellhead components are available that are constructed to withstand high pressures, but it is not economical to equip every well with them.

There are many wellhead isolation tools used in the field that conduct corrosive and abrasive high pressure fluids and gases through the wellhead components to prevent damage to the wellhead.

The wellhead isolation tools known in the prior art generally insert a mandrel through the various valves and spools of the wellhead to isolate those components from the elevated pressures and the corrosive and abrasive fluids used in the well treatment, in order to stimulate production. A top end of a mandrel is connected to one or more high pressure valves, through which the stimulation fluids are pumped. In some applications, a pack-off assembly is provided at a bottom end of the mandrel for achieving a fluid seal against an inside of the production tubing or casing so that the wellhead is completely isolated from stimulation fluids. One such tool is described in Applicant's U.S. Pat. No. 4,867,243 which issued Sep. 19, 1989, and is entitled WELLHEAD ISOLATION TOOL AND SETTING TOOL AND METHOD OF USING SAME. The length of the mandrel need not be precise because the location of the pack-off assembly in the production tubing or casing is immaterial, so long as a pack-off assembly is sealed against the inner wall of the production tubing or casing. Consequently, variations in the length of the wellhead of different oil or gas wells are of no consequence.

In an alternate wellhead isolation tool configuration, the mandrel in an operative position requires fixed-point pack-off in the well. The mandrel includes an annular sealing body attached to the bottom end of the mandrel for sealing against a bit guide which is mounted on the top of a casing in the wellhead. A mechanical lock-down mechanism secures the mandrel against the bit guide. The annular sealing mechanism and the mechanical lock-down mechanism are described in Applicant's U.S. Pat. No. 4,867,243, which issued on Sep. 19, 1989 and is entitled BLOWOUT PREVENTER PROTECTOR AND SETTING TOOL. This tool is inserted into the operative position using, for example, the setting tool described in Applicant's above-referenced U.S. Pat. No. 4,867,243. Although this setting tool works very well and has been repeatedly proven in high pressure well conditions, the setting tool has to be removed to provide access to the isolation tool. This requires time and equipment and slows down transition to the well stimulation process.

It is therefore desirable to integrate injectors with the tool for inserting the mandrel through the wellhead. An example of an isolation tool with integrated injectors is described in U.S. Pat. No. 4,241,786, which issued to Bullen on Dec. 30, 1980 and is entitled WELL TREE SAVER. Bullen's tool includes two hydraulic cylinders supported on a hydraulic cylinder mounting plate and off-set from the wellhead. The piston rods of the hydraulic cylinders are connected at their free ends to a base plate mounted to the top of the wellhead. The cylinder mounting plate bears a high pressure tube and a high pressure valve attached to the top of the high pressure tube. The high pressure valve extends upright from the hydraulic cylinder mounting plate and the top ends of the hydraulic cylinders are connected together by a cross member. Consequently, access to the high pressure valve is restricted and it is difficult or impossible to mount other equipment to the top of the high pressure valve, such as a blowout preventer, coil tubing injector, etc.

There is therefore a need for an improved well stimulation tool that includes integral injectors, while providing unobstructed access to a top of the tool.

SUMMARY OF THE INVENTION

It is an object of the present invention to provide an apparatus for protecting equipment in a wellhead from exposure to fluid pressures, abrasives and corrosive fluids used in a well treatment, and which is incorporated with injectors so that no additional injectors are needed to place the apparatus into an operative position.

It is another object of the present invention to provide an apparatus for protecting equipment in a wellhead from exposure to fluid pressures, abrasives and corrosive fluid used in a well treatment while permitting other equipment required in the well treatment to be mounted thereabove.

In accordance with one aspect of the present invention, an apparatus is provided for protecting equipment in a wellhead from exposure to fluid pressure, abrasives and corrosive fluids used in a well treatment to stimulate production. The apparatus includes a tool adapted to be inserted through a wellhead to an operative position. The tool includes a base plate adapted to be connected to a top end of the wellhead and a top plate at a top end thereof for supporting equipment selectively mounted to the tool. A pair of injectors is provided in a parallel relationship and is located at opposed sides of the respective base and top plates. Each injector has opposed ends secured to the base plate and the top plate, respectively, so that the injectors can move a portion of the tool reciprocally through the wellhead into and out of the operative position when the base plate is connected to the top end of the wellhead. The injectors preferably include a pair of hydraulic injectors. Each hydraulic injector includes a cylinder and a piston rod extendable from the cylinder, thereby forming a cylinder end and a rod end of the hydraulic injector. The cylinder end is secured to and flush with the top plate and the rod end is connected to the base plate.

More especially, according to an embodiment of the present invention, the tool includes a base plate adapted to be inserted into a top of the wellhead and a mandrel adapted to be inserted down through the wellhead to the operative position. The base plate preferably includes a fluid seal through which the mandrel is reciprocally movable in a passage extending therethrough. The mandrel includes an annular sealing body secured to a bottom end thereof for sealing engagement within a tubing head spool above a bit guide at a top of a casing of the well when the mandrel is in the operative position. A mandrel head is preferably connected to a top end of the mandrel, and includes a passage extending therethrough and in fluid communication with the mandrel. The mandrel head is releasably secured for example, by a lock nut around the mandrel, to the base plate when the mandrel is inserted through the wellhead into the operative position. The tool preferably further includes a high pressure valve mounted to the mandrel head and in fluid communication with the passage of the mandrel head. An adapter is preferably mounted to the top of the high pressure valve and has a central passage in fluid communication with the high pressure valve. The adapter is secured to the top plate so as to connect the equipment selectively mounted to the high pressure valve.

In accordance with another embodiment of the present invention, the tool further includes a fracturing head located between the high pressure valve and the mandrel head. The fracturing head includes an axial passage in fluid communication with the mandrel and the high pressure valve, and at least one radial passage in fluid communication with the axial passage.

The annular sealing body preferably includes at least one O-ring attached therearound to seal a gap between the annular sealing body and an interior wall of the tubing head spool. Thus, the bottom end of the annular sealing body is adapted to rest on the top of the bit guide to bear the entire weight of the apparatus, the equipment mounted on the top of the apparatus, and even the weight of a tubing string.

In accordance with another aspect of the invention, a method is described for protecting equipment in a wellhead from exposure to fluid pressures, abrasives and corrosive fluids used in a well treatment to stimulate production. The method comprises: a) suspending above the wellhead an apparatus which includes a tool having a mandrel adapted to be inserted through a wellhead to an operative position, the tool including a base plate adapted to be connected to a top end of the wellhead and a top plate at a top end of thereof, and which further includes a pair of injectors in a parallel relationship located at opposed sides of the respective base and top plates, each injector having opposed ends secured to the base plate and the top plate, respectively; b) aligning the mandrel with the wellhead and lowering the apparatus until the apparatus rests on the wellhead, and mounting the base plate to the wellhead; c) opening a fluid flow control mechanism of the wellhead to permit access to a well bore; d) actuating the injectors to insert the mandrel through the wellhead into an operative position in which an annular sealing body at a bottom end of the mandrel is in a fluid sealing engagement within a tubing head spool above a bit guide at a top of a casing of the well; e) locking the mandrel in the operative position; and f) connecting the apparatus to a high pressure fluid line for well stimulation.

In accordance with a further aspect of the present invention, a method is described for running a tubing string into a well while protecting equipment in a wellhead from exposure to fluid pressures, abrasives and corrosive fluids used in a well treatment or well service operation. The method comprises: a) mounting to the wellhead a base plate of an apparatus, the apparatus including a tool having a mandrel adapted to be inserted through a wellhead to an operative position, the tool further including a fracturing head having an axial passage and at least one radial passage in fluid communication with the axial passage, a high pressure valve mounted to the fracturing head and a top plate connected to a top of the high pressure valve, and the apparatus further including a pair of injectors in a parallel relationship located at opposed sides of the respective base and top plates, each injector having opposed ends secured to the base plate and the top plate, respectively; b) aligning the mandrel with the wellhead and lowering the apparatus until the apparatus rests on the wellhead, and mounting the base plate to the wellhead; c) opening a fluid flow control mechanism of the wellhead to permit access to a well bore; d) actuating the injectors to insert the mandrel through the wellhead into an operative position in which an annular sealing body at a bottom end of the mandrel is in a fluid sealing engagement within a tubing head spool above a bit guide at a top of a casing of the well; e) locking the mandrel in the operative position; and f) running the tubing string into the wellbore through at least one blowout preventer mounted to the top plate and in fluid communication with the high pressure valve of the apparatus.

The apparatus of the present invention has a relatively simple configuration and provides direct access to the well so that the use of the apparatus is extended to a wide range of well service applications. The apparatus of the present invention advantageously permits the tubing string to run in or out of the well without moving the apparatus from the wellhead. The tubing string can even be moved up or down in the well while well treatment fluids are being pumped into the well. Labour and the associated costs are thus reduced.

Other advantages and features of the present invention will be better understood with reference to preferred embodiments of the present invention described hereinafter.

BRIEF DESCRIPTION OF THE DRAWINGS

Having thus generally described the nature of the present invention, the invention will now be further described by way of illustration only and with reference to the accompanying drawings in which.

DETAILED DESCRIPTION OF THE PREFERRED EMBODIMENT

Figure 1:
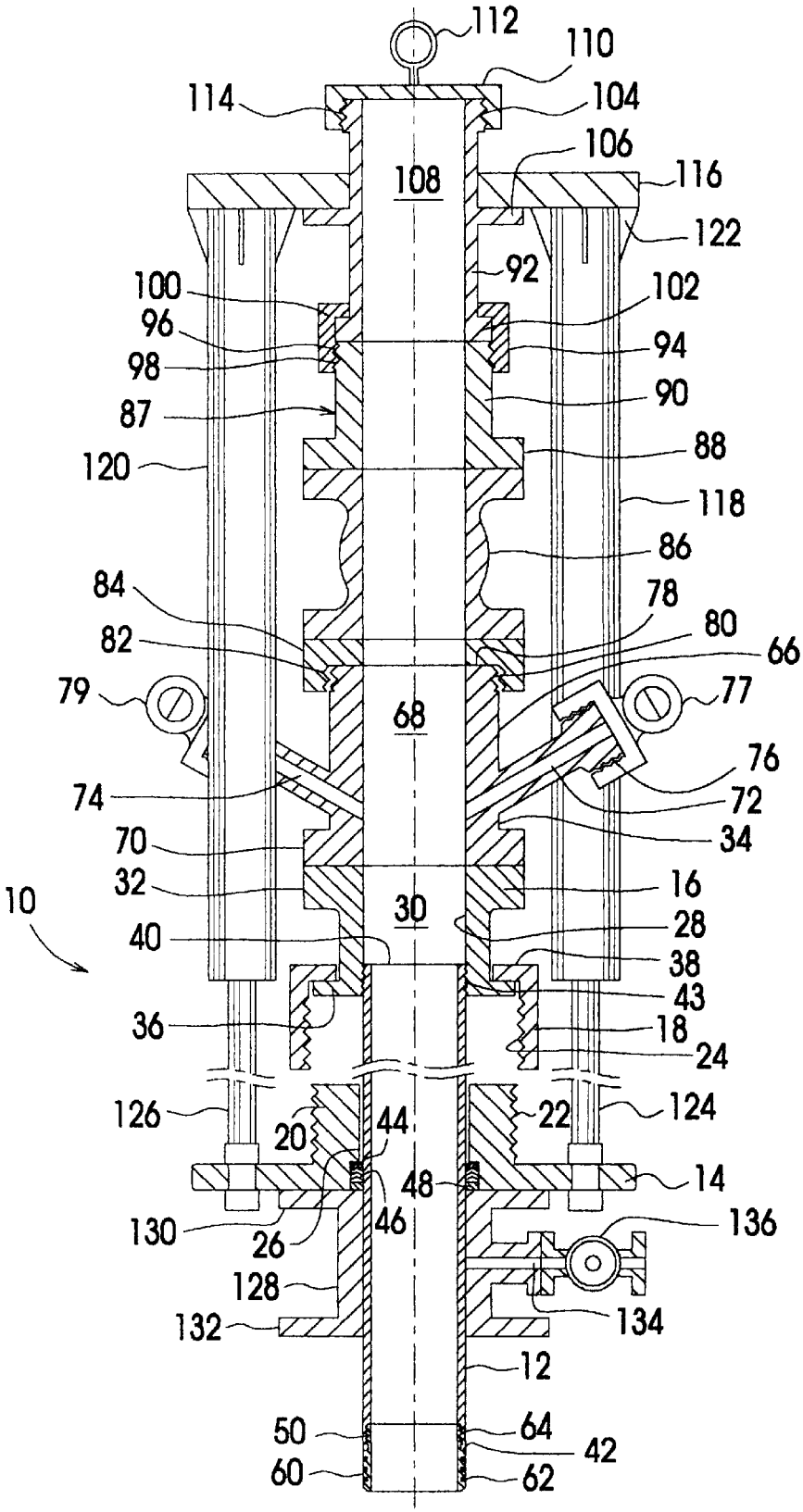
FIG. 1 is a cross-sectional view of an embodiment of the apparatus in accordance with the present invention.

FIG. 1 shows a cross-sectional view of the apparatus for protecting equipment in a wellhead in accordance with the present invention, generally indicated by reference numeral 10. The apparatus includes a mandrel 12, a base plate 14, a mandrel head 16 and a lock-down nut 18 that detachably interconnects the base plate 14 and the mandrel head 16. The base plate 14 includes a flange and integral sleeve 20 that is perpendicular to the base plate 14. A spiral thread 22 is provided on an exterior of the integral sleeve 20. The spiral thread 22 is engageable with a complementary spiral thread 24 on an interior surface of the lock-down nut 18. The flange of the base plate 14 with the integral sleeve 20 form a passage 26 that permits the mandrel 12 to reciprocate therethrough. The mandrel head 16 includes an annular flange having a central passage 30 defined by an interior wall 28 thereof. A top flange 32 of the mandrel head 16 is adapted for connection to a fracturing head 34. A bottom flange 36 of the mandrel head 16 retains a top flange 38 of the lock-down nut 18. The lock-down nut 18 secures the mandrel head 16 from upward movement with respect to the base plate 14 when the lock-down nut 18 engages the spiral thread 22 on the integral sleeve 20.

The mandrel 12 has a mandrel top end 40 and a mandrel bottom end 42. Complementary spiral threads 43 are provided on the exterior of the mandrel top end 40 and on a bottom end of the interior wall 28 of the mandrel head 16 so that the mandrel top end 40 can be securely attached to the mandrel head 16. One or more O-rings (not shown) provide a fluid-tight seal between the mandrel head 16 and the mandrel 12. The passage 26 through the base plate 14 has a recessed region at the bottom end for receiving a steel spacer 44 and packing rings 46 preferably constructed of brass, rubber and fabric. The steel spacer 44 and packing rings 46 define a passage of the same diameter as the periphery of the mandrel 12. The packing rings 46 are removable and may be interchanged to accommodate different sizes of mandrels 12. The steel spacer 44 and packing rings 46 are retained in the passage 26 by a retainer nut 48. The combination of the steel spacer 44, packing rings 46 and the retainer nut 48, provide a fluid seal to prevent passage to the atmosphere of well fluids from the annulus between an exterior of the mandrel 12 and the interior of the wellhead (not shown) when the mandrel 12 is inserted into the wellhead, as will be described below with reference to FIGS. 4 and 5.

Figure 3:
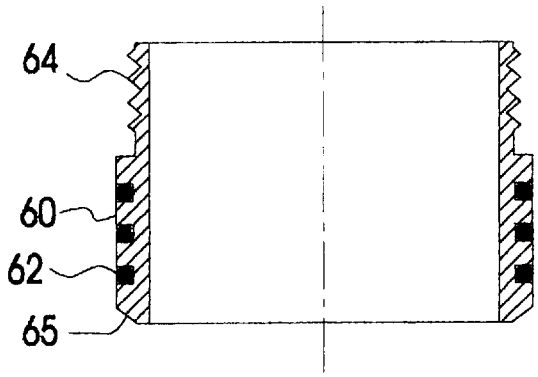
FIG. 3 is a cross-sectional view of an annular sealing body used in the embodiments of FIGS. 1, 1A and 2.

An internal threaded connector 50 on the mandrel bottom end 42 is adapted for the connection of an optional mandrel extension (not shown) or an annular sealing body 60 which is more clearly shown in FIG. 3, and includes for example, three O-ring seals 62. The O-ring seals 62 are retained in corresponding annular grooves on the external surface of the annular sealing body 60. An external threaded connector 64 is provided on the top end of the annular sealing body 60 for engagement with the internal threaded connector 50 of the mandrel 12. High pressure O-ring seals (not shown) are also provided in the threaded connectors between the mandrel 12 and the annular sealing body 60 to prevent fluid leakage under high pressure. A bottom end 65 of the annular sealing body 60 is contoured to correspond with a top of a bit guide at a top of a casing of the well, which will be further described hereinafter.

The mandrel 12, the mandrel extension if any, and the annular sealing body 60 are preferably each made from 4140 steel, a high strength steel which is commercially available. 4140 steel has a high tensile strength and a Burnell hardness of about 300. Consequently, the assembled mandrel 12 is adequately robust to contain extremely high fluid pressures of up to 15,000 psi, which approaches the burst pressure of the well casing.

The fracturing head 34 includes a side wall 66 surrounding an axial passage 68 that has a diameter not smaller than the internal diameter of the mandrel 12. A bottom flange 70 of the fracturing head 34, is provided for connection in a fluid-tight seal to the mandrel head 16. Two or more radial passages 72, 74 extending from the axial passage 68 with treaded connectors 76 (only one shown) are provided to permit well stimulation fluids to be pumped through the wellhead. Valves 77, 79 threadingly engage the connectors 76, to permit control of the fluid flow through the respective radial passages 72, 74. The radial passages 72, 74 are preferably oriented at an acute upward angle with respect to the side wall 66. At the top end 78 of the side wall 66, a threaded connector 80 removably engages a complementary threaded connector 82 of a flange 84. Seals (not shown) are provided between the flange 84 and the side wall 66 to prevent fluid leakage. Alternatively, the flange 84 may be an integral part of the fracturing head 34, or the top 78 of the fracturing head 34 may terminate in a stud pod, in a manner well known in the art.

A high pressure valve 86 is sealingly mounted to the top of the flange 84. An adapter 87, with a bottom flange 88 and an integral sidewall 90 is mounted in a high-pressure fluid seal to the top of the high pressure valve 86. An adapter spool 92 is sealingly connected to the top of the adapter 87 by a hammer union 94, or the like. The hammer union 94 includes an interior thread 96 adapted to engage an external thread 98 on the top of the adapter 87, and a top flange 100 of the hammer union 94 engages a bottom flange 102 of the adapter spool 92. The adapter spool 92 includes a threaded connector 104 at the top end thereof for connecting other equipment as required, and a radial flange 106. A central passage 108 is in fluid communication with the high pressure valve 86, as well as the axial passage 68 of the fracturing head 34 when the high pressure valve 86 is open. The central passage 108 has a diameter equal to or longer than the axial passage 68 through the fracturing head 34. A cap 110 with a lifting eye 112 attached to the top thereof has an interior threaded connector 114 for threaded engagement with the external threaded connector 104 of the adapter spool 92.

The apparatus 10 further includes a connector plate 116 having a central opening to permit the top end of the adapter spool 92 to extend therethrough. The connector plate 116 is secured to the radial flange 106 by, for example, welding or mechanical fasteners. A pair of injectors are provided for inserting the mandrel. In the illustrated embodiment, the injectors are hydraulic cylinders 118 and 120. As will be understood by those skilled in the art, the injectors may likewise be mechanical screws, ball jacks, or any other mechanical means for inserting the mandrel into the wellbore, including chain blocks or the like.

The hydraulic cylinders 118 and 120 are connected in a parallel relationship to a bottom of the top plate 116. The hydraulic cylinders 118, 120 are secured to opposed sides of the top plate 116 by welding, for example. Braces 122 may be provided to reinforce the connection between the hydraulic cylinder 118, 120 and the connector plate 116. Piston rods 124, 126 movably extend downwards from the respective hydraulic cylinders 118, 120 and are connected at their bottom ends to opposed sides of the base plate 14, by fasteners that are well known in the art. Thus, the connector plate 116 constitutes a support platform accessible from all directions to permit equipment to be connected to the top of the adapter spool 92.

A bleed spool 128 may be provided below the base plate 14, surrounding a lower portion of the mandrel 12. The bleed spool 128 includes a top flange 130, which is sealingly mounted to the bottom of the base plate 14, and a bottom flange 132 which is adapted to be sealingly mounted to a top end of a wellhead. The bleed spool 128 has a bleed port 134 in fluid communication with the central passage defined by the interior wall of the bleed spool 128, and is sealingly connected to a bleed valve 136 which selectively closes the bleed port 134. The apparatus 10 shown in FIG. 1 is in a pre-assembled condition and in a position in which the piston rods 124, 126 of the hydraulic cylinders 118, 120 are partially extended so that only a lower section of the mandrel 12 extends downwardly from a bottom of the bleed spool 128.

Figure 1A:
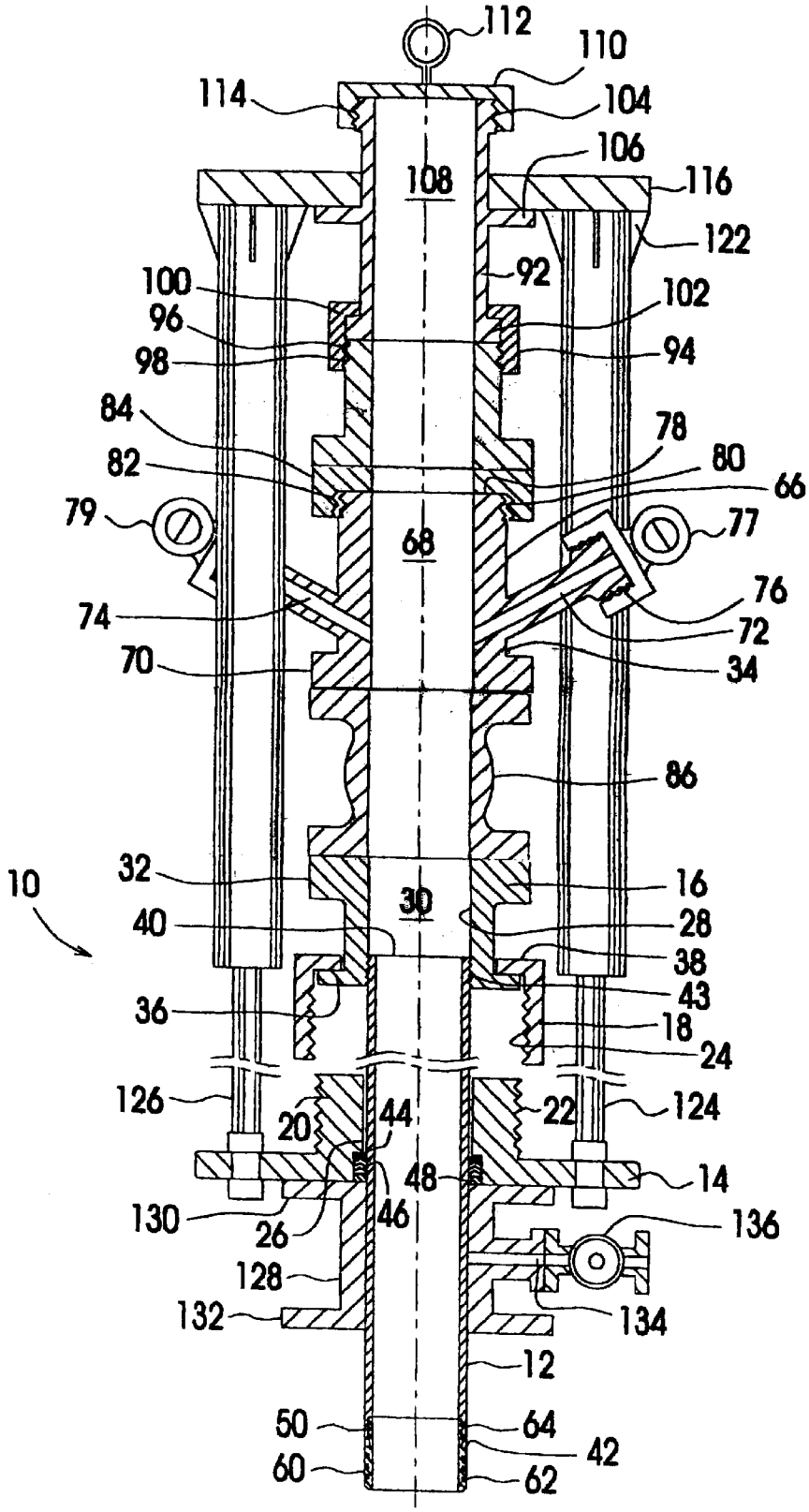
FIG. 1A is a cross-sectional view of another embodiment of the apparatus in accordance with the invention.

Another embodiment of the present invention is shown in FIG. 1A. The embodiment shown in FIG. 1A is identical to that shown in FIG. 1, with the exception that the high pressure valve 86 is mounted to the top flange 32 of the mandrel head 16, below the fracturing head 34. This permits the wellbore to be closed if an emergency situation develops, a high pressure line bursts, for example. In all other respects, the embodiment shown in FIG. 1A is identical to the embodiment shown in FIG. 1 and the remaining parts have all been described above in detail.

Figure 2:
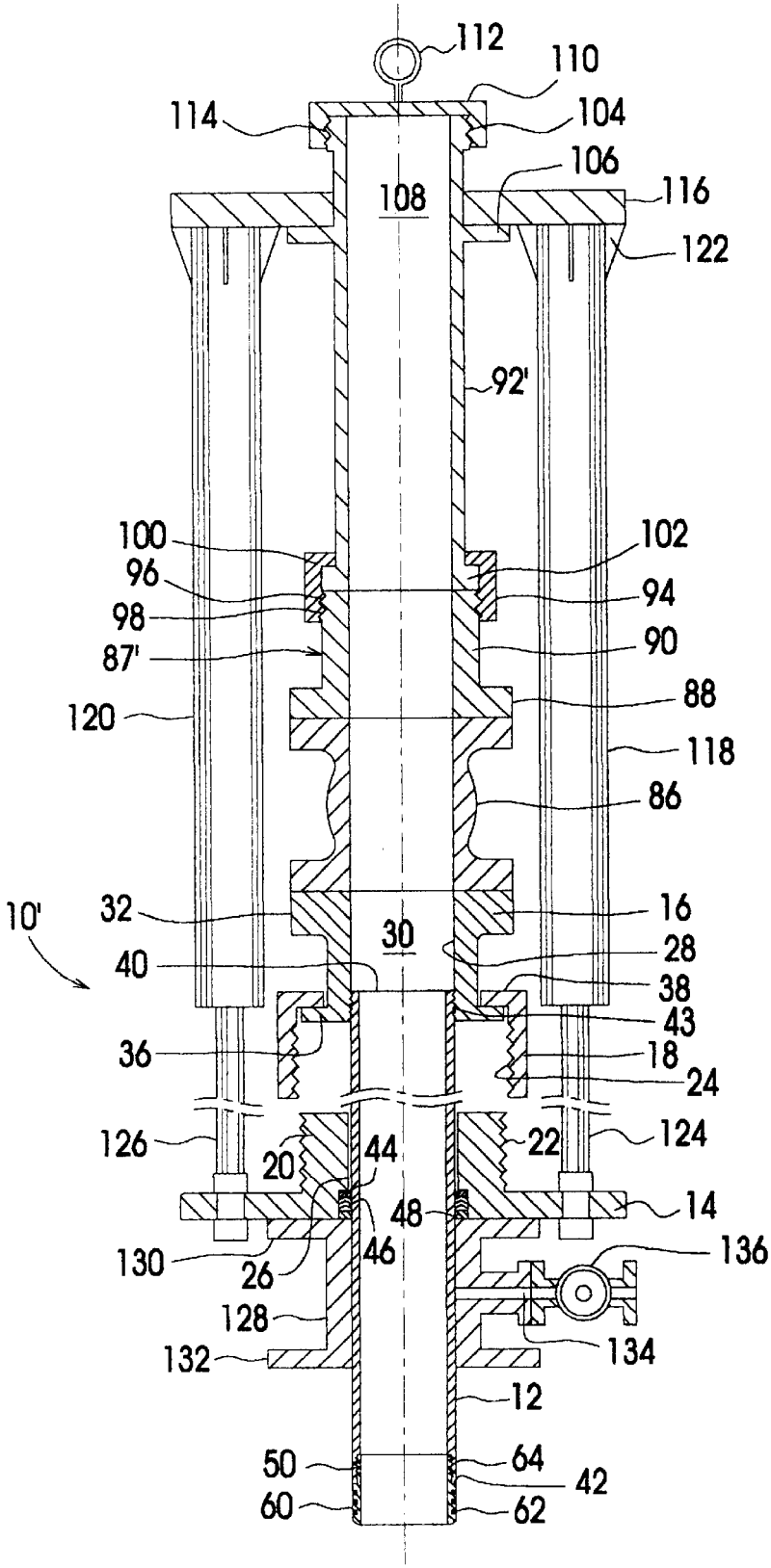
FIG. 2 is a cross-sectional of yet another embodiment of the apparatus in accordance with the invention.

Another embodiment of the present invention is shown in FIG. 2, and is generally referred to as apparatus 10' which is similar to and simpler than the apparatus 10 shown in FIG. 1. Similar components are indicated by similar reference numerals, and the description will therefore not be repeated. In contrast to apparatus 10 shown in FIG. 1, apparatus 10' does not include the fracturing head 34, and therefore the high pressure valve 86 is mounted in a fluid seal directly to the mandrel head 16. The adapter 87' mounted to the top of the high pressure valve 86 connects to an elongated adapter spool 92' which is longer than the adapter spool 92 of apparatus 10 shown in FIG. 1, in order to extend the lock-down nut 18 on the mandrel head 16 to a position near a lower end of hydraulic cylinders 118, 120, so that the hydraulic cylinders 118, 120 do not interfere with the connection of the lock-down nut 18 to the integral sleeve 20 of the base plate 14 when the mandrel 12 is inserted through a wellhead into the operative position.

Figure 4:
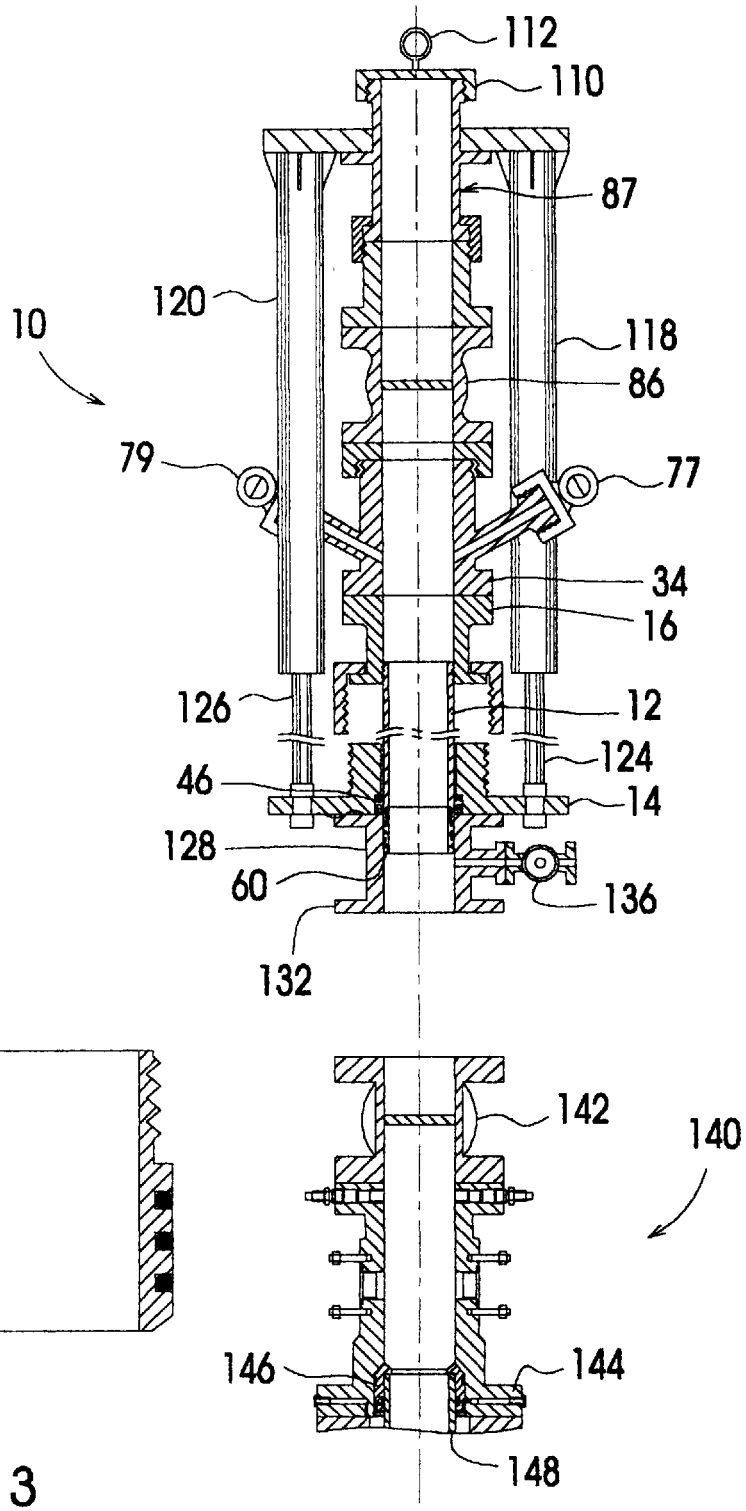
FIG. 4 is a cross-sectional view of the apparatus shown in FIG. 1 suspended over a wellhead prior to installation on the wellhead.
Figure 5:
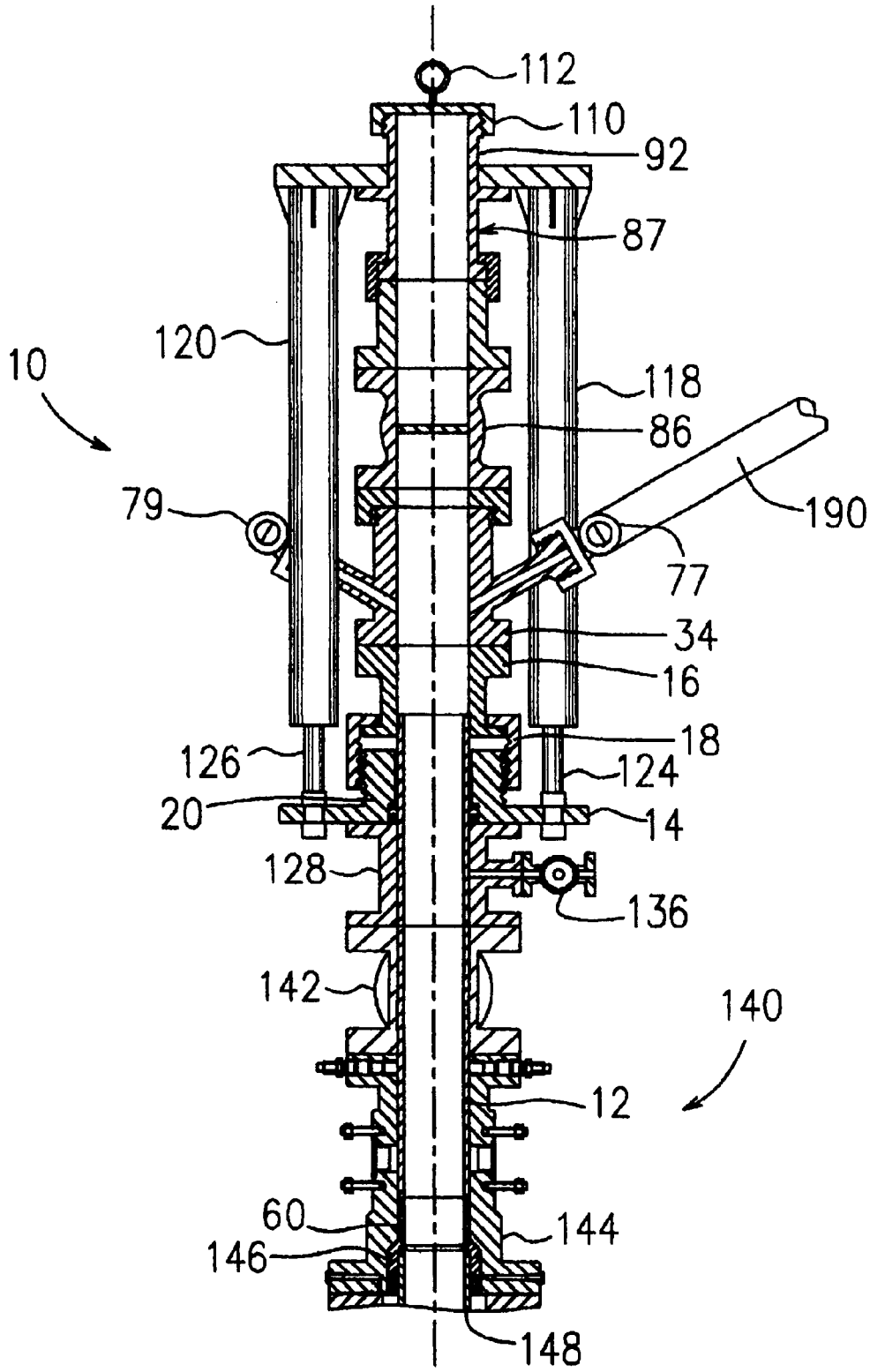
FIG. 5 is a cross-sectional view of the apparatus shown in FIG. 4 illustrating a further step in the installation procedure, in which the mandrel of the apparatus is inserted through the wellhead and locked in an operative position.

FIGS. 4 and 5 illustrate the installation procedure of the apparatus 10 to a wellhead 140. Several components may be included in a wellhead. For the purposes of illustration, the wellhead 140 is simplified and includes only a fluid control mechanism for example, a gate valve 142 and a tubing head spool 144 which are both well known in the art, and their construction and function do not form a part of this invention. The gate valve 142 and the tubing head spool 144 are, therefore, not described.

As illustrated in FIG. 4, the pre-assembled apparatus 10 is suspended over the wellhead 140 by a crane or other lift equipment (not shown). Both the high pressure valve 86 and gate valve 142 are closed. The piston rods 124, 126 are extended from hydraulic cylinders 118, 120 so that the annular sealing body 60 is located above the bleed valve 136 and below the packing rings 46, which is preferred for a pressure equalizing procedure. The mandrel 12 is hydraulically locked by the hydraulic cylinders 118, 120 in that position relative to the base plate 14 and the bleed spool 128 during installation. The apparatus 10 is aligned with the wellhead 140 and lowered until the bottom flange 132 of the bleed spool 128 rests on the top flange of the gate valve 142.

After the bottom flange 132 of the bleed spool 128 rests on the gate valve 142, the bleed spool 128 is secured to the top of the gate valve 142 in a fluid-tight seal, using a flange gasket or the like. A pressure equalization hose (not shown) is connected to the bleed valve 136 and the tubing head spool 144 in order to equalize the pressure difference across the gate valve 142. Before the bleed valve 136 is opened to balance the pressure, the high pressure valve 86 and valves 77, 79 must be closed so that the well fluids are contained within the apparatus 10.

After the well fluid pressure difference across the gate valve 142 is balanced, the gate valve 142 is opened for access to the wellbore and the hydraulic cylinders 118, 120 are actuated to insert the mandrel 12 through the wellhead 140 into its operative position, as shown in FIG. 5. In the operative position, the bottom end 65 of the annular sealing body 60, as more clearly shown in FIG. 3, is contoured for abutment with the top of a bit guide 146 at a top of a casing 148, and rests on the top of the bit guide 146 so that the entire weight of the apparatus 10 is supported by the bit guide 146 and the casing 148. The O-ring seals 62 of the annular sealing body 60 shown in FIG. 3 contact the interior surface of the tubing head spool 144 immediately above the bit guide 146. After the mandrel 12 is inserted through the wellhead 140 into the operative position, the lock-down nut 18 may be rotated to threadingly engage the integral sleeve 20 of the base plate 14 in order to lock the mandrel against upward movement relative to the base plate 14 during a stimulation treatment.

Alternatively, the mandrel 12 can be a little shorter than the one shown in FIG. 5, so that the mandrel head 16 abuts the integral sleeve member 20 of the base plate 14 and the annular sealing body 60 does not contact the top of the bit guide 146. In such this alternative arrangement, the weight of the apparatus 10 is supported by the wellhead 140 and weight is not transferred to the bit guide. The O-ring seals 62 of the annular sealing body 60 shown in FIG. 3 contact the interior surface of the tubing head spool 144 in a location in which the side wall of the tubing head spool 144 is strengthened to withstand higher fluid pressures. The remaining section of the tubing head spool 144 above the seal provided by the annular sealing body 60, and other equipment in the wellhead above the tubing head spool 144 are well protected by the mandrel 12 from exposure to fluid pressures, abrasives and corrosive fluids during well fracturing and stimulation procedures.

After the installation procedure is completed, a high pressure fluid line can be connected to the apparatus 10, either through adapter spool 92 after the cap 110 is removed, or directly to the valves 77, 79, so that the abrasive and/or corrosive fluids can be pumped at high pressures through the apparatus 10 into the well to stimulate production when the corresponding valves are opened.

Apparatus 10' shown in FIG. 2 can also be mounted to a wellhead for a well fracturing and stimulation operation. The installation of apparatus 10' to a wellhead is similar to the installation of the apparatus 10 of FIGS. 4 and 5 to the wellhead 140 and is therefore not redundantly described. In order to perform well fracturing and well stimulation procedures, the high pressure fluid line is connected to the top of the adapter spool 92' after the cap 110 is removed.

Figure 6:
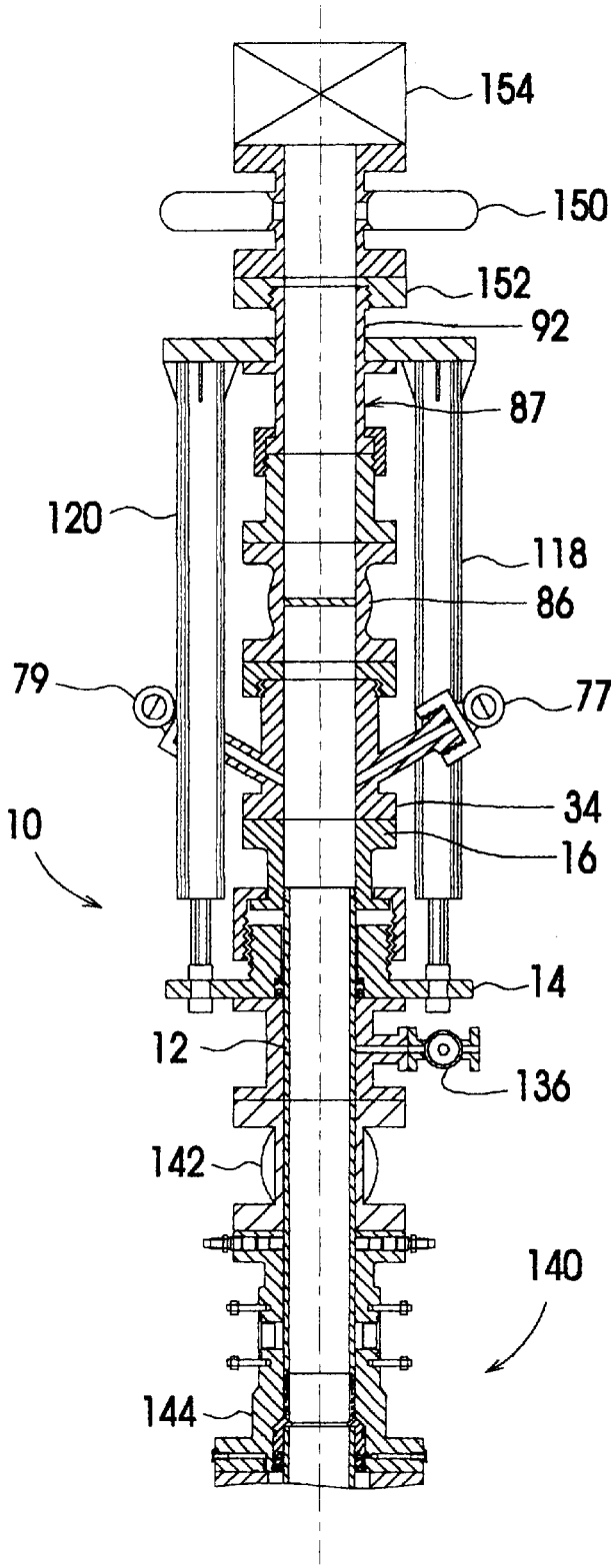
FIG. 6 is a partial cross-sectional view of the apparatus shown in FIG. 5 illustrating a further step in the installation procedure, in which a blowout preventer and a coil tubing injector are mounted to the top of the apparatus.
Figure 7:
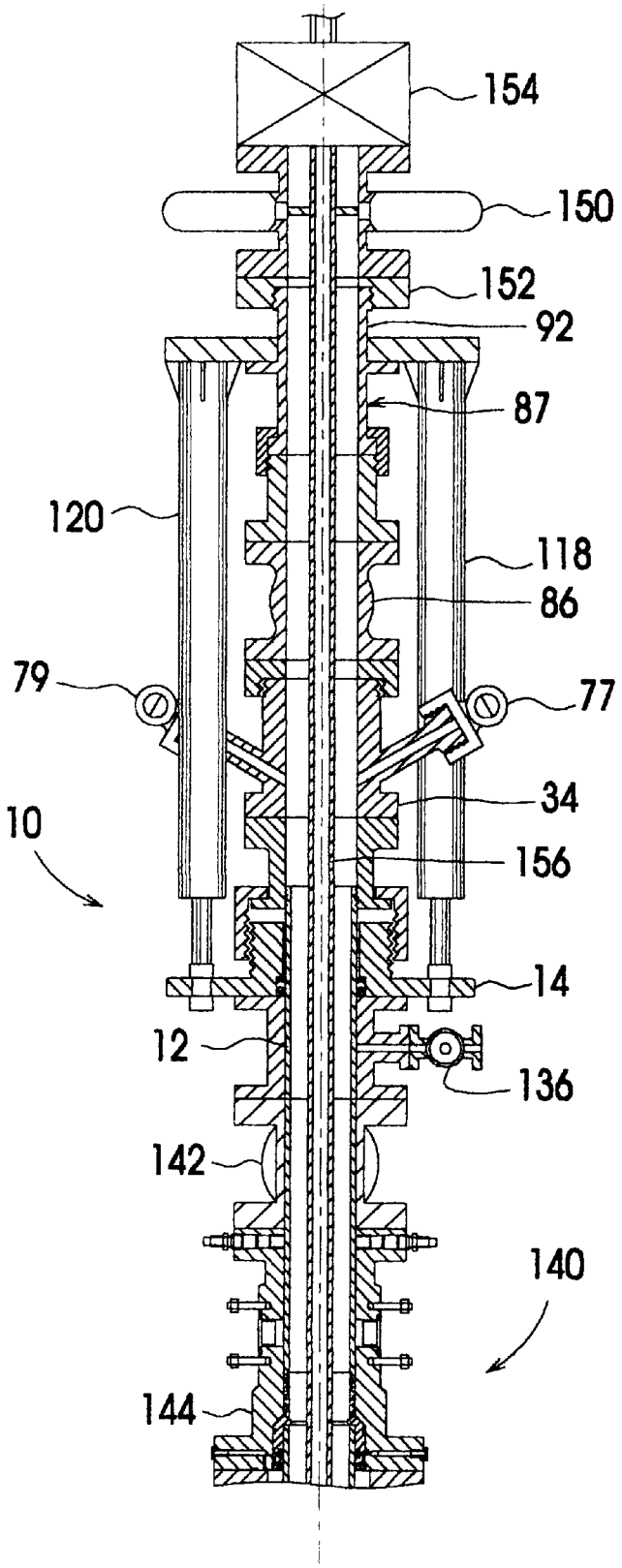
FIG. 7 is a partial cross-sectional view of the apparatus shown in FIG. 6 illustrating a final step in the installation procedure, in which a coil tubing string is run into the well by the coil tubing injector.

FIGS. 6 and 7 illustrate procedures for running a coil tubing string 156 through the apparatus 10 and into a well.

After the installation of apparatus 10 is completed and the mandrel 12 is inserted into the operative position, a blowout preventer 150 is hoisted by a crane or a boom truck (not shown) above the apparatus 10 and is connected to the top of the adapter spool 92 using a flange or hammer union connector 152. The connection provides a fluid-tight seal in order to prevent fluid leakage during well fracturing and stimulation procedures. A coil tubing injector 154 is mounted to the top of the blowout preventer 150 as shown in FIG. 6, to permit a coil tubing string 156 to be inserted into, or withdrawn from the well. The blowout preventer 150 and coil tubing injector 154 are well known in the art and are not part of the present invention. The high pressure valve 86 and the valves 77, 79 are closed, so that the well fluid under pressure is contained within the apparatus 10 below the high pressure valve 86.

As illustrated in FIG. 7, the coil tubing string 156 is injected by the coil tubing injector 154 through the blowout preventer 150 and into the adapter spool 92 above the high pressure valve 86 which is closed to contain the well fluid within the apparatus 10. The tubing rams of the blowout preventer 150 are closed around the coil tubing string 156 to seal the annulus between the exterior periphery of the coil tubing string 156 and the interior wall of the blowout preventer 150. A pressure equalization hose (not shown) is then provided to connect the bleed valve 136 to a bleed port (not shown) of the blowout preventer 150 in order to balance a fluid pressure difference across the closed high pressure valve 86. After the fluid pressure difference is balanced, the high pressure valve 86 is opened and the coil tubing string 156 is further injected by the coil tubing injector 154 into the well, as shown in FIG. 7, until the coil tubing string 156 reaches a required depth.

The apparatus 10, in accordance with the above described embodiment of the present invention, has extensive applications in well treatments to stimulate production. The high pressure fluid line 190 (shown in FIG. 5) can be hooked up to valves 77, 79 and through an additional high pressure valve (not shown) to an end of the coil tubing string in order to perform a wellhead stimulation treatment. A high pressure well stimulation fluid can be pumped down into the well through any one or more of the three valves. The coil tubing string 156 can also be used to pump a fluid or gas down into the well while other materials are pumped down the casing annulus so that the fluids only commingle downhole at the perforation area and are only mixed in the well.

In the event of a "screen out" the high pressure valve that controls the coil tubing string 156 may be opened and hooked to the pit. This permits the coil tubing string 156 to be used as a well evacuation string, so that the fluids can be pumped down the annulus of the casing and up the coil tubing string 156 in order to clean and circulate proppants out of the wellbore. In other applications for well stimulation treatment, the coil tubing string 156 can be used as a dead string to measure downhole pressure during a well fracturing process.

The coil tubing string 156 can also be used to spot acid in the well. In order to operate for a spot acid treatment, a lower limit of the area to be acidized is blocked off with a plug set in the well below a lower end of the coil tubing string 156, if required. A predetermined quantity of acid is then pumped down the coil tubing string 156 to treat a portion of the wellbore above the plug. The area to be acidized may be further confined by a second plug set in the well above the first plug. Acid may then be pumped under pressure through the coil tubing string 156 into the area between the two plugs.

Figure 8:
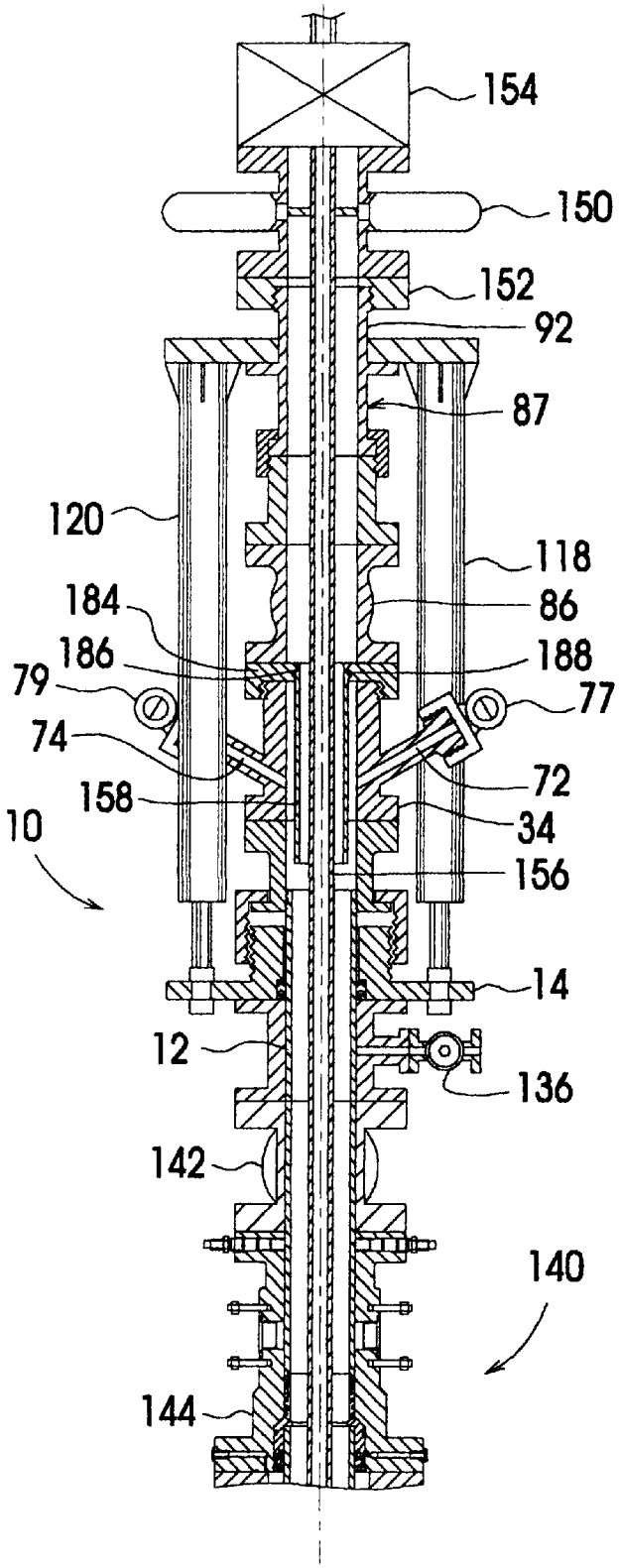
FIG. 8 is a partial cross-sectional view of the apparatus of the present invention having an alternate embodiment of the fracturing head which is adapted to secure a blast joint therein in order to protect the coil tubing from erosion when abrasive fluids are pumped through the fracturing head.

FIG. 8 illustrates a configuration of the apparatus 10 in accordance with a further embodiment of the invention, which further includes a blast joint 158 to protect the coil tubing string 156 from abrasive proppants. Accordingly, the flange connector 184 of the fracturing head 34 in this embodiment, is different from the flange connector 84 shown in FIG. 1. The flange connector 184 has an internal diameter smaller than the internal diameter of the fracturing head 34 and has an internal thread 186 for engaging a threaded top end 188 of the blast joint 158 so that the blast joint 158 is secured to the flange connector 184 and suspended therefrom. The blast joint 158 has an inner diameter large enough to permit the coil tubing string 156 to be run up and down therethrough. The blast joint 158 protects the coil tubing string 156 from erosion when abrasive fluids are pumped through the radial passages 72, 74 in the fracturing head 34. As is understood by those skilled in the art, a "stripper" for removing hydrocarbons from the coil tubing string 156 pulled out of the well may also be associated with the blowout preventer 150.

The apparatus 10 in accordance with the invention does not restrict fluid flow along the annulus of the casing or include components susceptible to wash-out. More advantageously, the apparatus 10 in accordance with the invention enables an operator to move the tubing string 156 up and down, or run coil tubing into or out of a well, without removing the apparatus 10 from the wellhead. The tubing string 156 can also be moved up or down in the well while stimulation fluids are being pumped into the well, as will be understood by those skilled in the art. The apparatus 10 is especially well adapted for use with coil tubing, which provides a safer operation in which there are no joints, no leaking connections and no snubbing units needed, if it is run in under pressure.

The apparatus in accordance with the invention further advantageously provides an easy access to the top of the apparatus in order to permit any desired equipment to be mounted to the tool. This permits a blowout preventer, coil tubing injectors, lubricator, wireline unit, or any other control stack spooi or injection tool to be mounted to the tool 10. Since the top of the tool 10 is located only a short distance above the top of the wellhead when the mandrel 12 is inserted into the operative position, any piece of equipment mounted to the tool 10 is low, and rigidly supported, which increases safety and improves working conditions. It should also be noted that the opposed cylinders 118, 120 strengthen and support the top of the tool 10 to further increase rigidity.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

I claim:

1. An apparatus for protecting equipment in a wellhead of a well from exposure to fluid pressures, abrasives and corrosive fluids used in a well treatment to stimulate production, comprising:

a tool adapted to be inserted through the wellhead of the wellhead into an operative position, the tool including a base plate adapted to be connected to a top end of the wellhead and a connector plate at a top end thereof for supporting equipment selectively mounted to the tool; and a pair of injectors in a parallel relationship located at respective opposed sides of the base plate and connector plate, each injector having opposed ends secured to the base plate and the connector plate, respectively, so that the injectors can reciprocate a mandrel of the tool through the wellhead into and out of the operative position when the base plate is connected to the top end of the wellhead.

2. An apparatus as claimed in claim 1 wherein the injectors comprise a pair of hydraulic cylinders, each including a cylinder and a piston rod extendable from the cylinder and thereby forming a cylinder end and a rod end of the injector, the cylinder end being secured to a bottom of the connector plate, and the rod being connected to the base plate.

3. An apparatus as claimed in claim 2 wherein the tool comprises a mandrel adapted to be inserted down through the wellhead into the operative position, the mandrel including an annular sealing body secured to a bottom end thereof for sealing engagement within a tubing head spool above a bit guide at a top of a casing of the well when the mandrel is in the operative position.

4. An apparatus as claimed in claim 3 wherein the tool further comprises a mandrel head connected to a top end of the mandrel, the mandrel head including a passage that extends therethrough and is in fluid communication with the mandrel, the mandrel head being releasably secured to the base plate when the mandrel is inserted through the wellhead into the operative position.

5. An apparatus as claimed in claim 4 wherein the tool further comprises a high pressure valve mounted to the mandrel head and in fluid communication with the passage through the mandrel head.

6. An apparatus as claimed in claim 5 wherein the tool further comprises an adapter spool mounted to a top of the high pressure valve, the adapter spool having a central passage in fluid communication with the high pressure valve, the adapter spool being secured to the connector plate to permit equipment to be selectively mounted to a top of the apparatus.

7. An apparatus as claimed in claim 6 further comprising a fracturing head mounted between the high pressure valve and the mandrel head, the fracturing head including an axial passage in fluid communication with the mandrel and the high pressure valve, and at least one radial passage in fluid communication with the axial passage.

8. An apparatus as claimed in claim 6 further comprising a fracturing head mounted between the high pressure valve and the adapter spool, the fracturing head including an axial passage in fluid communication with the mandrel and the high pressure valve, and at least one radial passage in fluid communication with the axial passage.

9. An apparatus as claimed in claim 1 wherein the base plate comprises a fluid seal in a passage extending therethrough, through which the mandrel is reciprocally movable.

10. An apparatus as claimed in claim 9 wherein the base plate further comprises a bleed valve for selectively closing a bleed port in fluid communication with the passage of through the base plate.

11. An apparatus as claimed in claim 4 wherein the mandrel head comprises a lock nut around the mandrel that may selectively be connected to a threaded connector on the base plate, to lock the mandrel in the operative position.

12. An apparatus as claimed in claim 3 wherein the annular sealing body comprises at least one O-ring to seal a gap between the annular sealing body and an interior wall of the tubing head spool.

13. An apparatus as claimed in claim 3 wherein the annular sealing body comprises a bottom end contoured for abutting the bit guide.

14. A method for protecting equipment in a wellhead of a well from exposure to fluid pressures, abrasives and corrosive fluids used in a well treatment to stimulate production of the well, comprising steps of:

a) suspending above wellhead of the well an apparatus which includes a tool having a mandrel adapted to be inserted through the wellhead to an operative position, the tool including a base plate adapted to be connected to a top end of the wellhead and a connector plate at a top end of the apparatus, and which further includes a pair of injectors mounted in a parallel relationship on opposed sides of the apparatus, each injector having opposed ends secured to the base plate and the connector plate, respectively;

b) aligning the mandrel with the wellhead and lowering the apparatus until the apparatus rests on the wellhead, and mounting the base plate to the wellhead;

c) opening a fluid flow control mechanism of the wellhead to permit access to a well bore;

d) actuating the injectors to insert the mandrel through the wellhead into the operative position in which an annular sealing body at a bottom end of the mandrel is in a fluid sealing engagement with an inner wall of a tubing head spool at a top of a casing of the well;

e) locking the mandrel in the operative position; and f) connecting the apparatus to a high pressure fluid line for well stimulation.

15. A method as claimed in claim 14 wherein the high pressure fluid line is connected to a high pressure valve which is in fluid communication with the mandrel and suspended from the connector plate.

16. A method as claimed in claim 14 comprising a further step of equalizing fluid pressure across the fluid flow control mechanism of the wellhead prior to step (c).

17. A method of running a tubing string into a well while protecting equipment in a wellhead of the well from exposure to fluid pressures, abrasives and corrosive fluids used in a well treatment or well service, comprising steps of:

a) mounting to wellhead of the well a base plate of an apparatus, the apparatus including a tool having a mandrel adapted to be inserted through a the wellhead to an operative position, the tool further including a fracturing head having an axial passage and at least one radial passage in fluid communication with the axial passage, a high pressure valve mounted to the fracturing head and a connector plate connected to a top of the high pressure valve, and the apparatus further including a pair of injectors located in a parallel relationship on opposed sides of the apparatus, each injector having opposed ends respectively secured to the base plate and the connector plate;

b) aligning the mandrel with the wellhead and lowering the apparatus until the apparatus rests on the wellhead, and mounting the base plate to the wellhead;

c) opening a fluid flow control mechanism of the wellhead to permit access to a well bore of the well;

d) actuating the injectors to insert the mandrel through the wellhead into the operative position in which an annular sealing body at a bottom end of the mandrel is in a fluid sealing engagement with an inner wall of a tubing head spool of the wellhead;

e) locking the mandrel in the operative position; and f) running the tubing string into the wellbore through at least one blowout preventer mounted to the connector plate.

18. A method as claimed in claim 17 further comprising steps, prior to step (f), of positioning the at least one blowout preventer above the connector plate and connecting the at least one blowout preventer in a fluid tight seal to the connector plate.

19. A method as claimed in claim 18 wherein the tubing string is a coil tubing string and is injected into the well using a coil tubing injector.

20. A method as claimed in claim 19 further comprising a step of mounting the coil tubing injector to a top of the blowout preventer.

21. A method as claimed in claim 17 further comprising a step of equalizing fluid pressure across the fluid flow control mechanism of the wellhead prior to step (c).

* * * * *

UNITED STATES PATENT AND TRADEMARK OFFICE

CERTIFICATE OF CORRECTION

PATENT NO. : 6,817,423 B2
DATED : November 16, 2004
INVENTOR(S) : L. Murray Dallas It is certified that error appears in the above-identified patent and that said Letters Patent is hereby corrected as shown below:

Title page,
Item [54], Title, please delete the word "WALL" and replace with -- WELL --.

Column 10,
Line 40, please delete "spooi" and replace with the word -- spool --.
Line 60, before "into an operative position" please delete the word "wellhead" and replace with -- well --.

Column 11,
Line 55, after "passage", please delete the word "of".

Column 12,
Line 41, after "through", please delete the word "a".

Signed and Sealed this

Nineteenth Day of July, 2005

JON W. DUDAS
*Director of the United States Patent and Trademark Office*